US008573920B2

(12) United States Patent
Ryf

(10) Patent No.: US 8,573,920 B2
(45) Date of Patent: Nov. 5, 2013

(54) STACKING DEVICE FOR PRINT PRODUCTS

(75) Inventor: Marc Ryf, Aarau (CH)

(73) Assignee: Mueller Martini Holding AG, Hergiswil (CH)

( * ) Notice: Subject to any disclaimer, the term of this patent is extended or adjusted under 35 U.S.C. 154(b) by 347 days.

(21) Appl. No.: 12/627,661

(22) Filed: Nov. 30, 2009

(65) Prior Publication Data

US 2010/0135762 A1 Jun. 3, 2010

(30) Foreign Application Priority Data

Nov. 28, 2008 (EP) ..... 08405293

(51) Int. Cl.
*B65H 31/28* (2006.01)
*B65H 31/30* (2006.01)

(52) U.S. Cl.
USPC ..... 414/788.3; 414/791; 414/792.2

(58) Field of Classification Search
USPC ..... 100/250; 198/370.07, 468.1, 468.11, 198/747; 271/192, 221, 222; 414/788.9, 414/789, 789.1, 789.3, 789.4, 789.9, 790.3, 414/790.6, 790.7, 792, 792.2, 792.3, 794.7, 414/907
See application file for complete search history.

(56) References Cited

U.S. PATENT DOCUMENTS

| | | | | | |
|---|---|---|---|---|---|
| 2,993,583 | A * | 7/1961 | Sykes | 198/370.07 |
| 3,533,213 | A * | 10/1970 | Lloyd | 53/500 |
| 3,563,360 | A * | 2/1971 | Wickersheim | 414/132 |
| 3,643,816 | A * | 2/1972 | Jacobsen | 414/788.9 |
| 4,085,566 | A * | 4/1978 | Crowe et al. | 53/529 |
| 4,103,785 | A | 8/1978 | Wiseman | |
| 4,708,237 | A * | 11/1987 | Buisson et al. | 198/726 |
| 5,092,236 | A | 3/1992 | Prim et al. | |
| 5,338,149 | A | 8/1994 | Wiseman | |
| 5,392,700 | A * | 2/1995 | Kleinhen | 100/7 |
| 5,868,548 | A | 2/1999 | Merwarth | |
| 6,106,219 | A * | 8/2000 | Newsome et al. | 414/790.6 |
| 2004/0140607 | A1* | 7/2004 | Honegger | 271/183 |
| 2005/0281655 | A1* | 12/2005 | Meier | 414/608 |
| 2007/0200287 | A1* | 8/2007 | Dax et al. | 271/220 |

FOREIGN PATENT DOCUMENTS

| | | | |
|---|---|---|---|
| DE | 4408780 | A1 * | 9/1995 |
| EP | 0 626 330 | | 11/1994 |
| EP | 0 829 441 | | 3/1998 |
| EP | 1167261 | A1 * | 1/2002 |
| EP | 1 362 817 | | 11/2003 |
| EP | 1445 224 | | 8/2004 |
| EP | 1826164 | A1 * | 8/2007 |

OTHER PUBLICATIONS

European Search Report Issued in Priority Application No. EP 08405293.5.

* cited by examiner

*Primary Examiner* — Gregory Adams
(74) *Attorney, Agent, or Firm* — Venable LLP; Robert Kinberg

(57) ABSTRACT

A stacking device for print products that includes a table to receive the print products such that the print products form a stack. The device also includes at least two ejector elements arrangeable against the stack to push the stack in an ejection direction away from the table. The stacking devices further includes at least two drive elements operatively connected, respectively, with the at least two ejector elements so that the at least two ejector elements move independent of one another.

15 Claims, 4 Drawing Sheets

STACKING DEVICE FOR PRINT PRODUCTS

CROSS-REFERENCE TO RELATED APPLICATION

This application claims the priority of European Patent Application No. 08405293.5, filed on Nov. 28, 2008, the subject matter of which is incorporated herein by reference.

BACKGROUND

The subject matter of the application relates to a stacking device for print products. The device comprises a table on which the print products may be stacked and at least two ejector elements or pushers. The ejector elements may be respectively placed against a stack forming on the table and may push the formed stack away from the table. The device may be furthermore provided with drive elements for operating the two ejector elements.

U.S. Pat. No. 5,868,548A provides a stacking device with two endlessly circulating chains, arranged on a rotating table, with respectively two finger-type ejector elements attached thereto that project in an upward direction. By simultaneously moving respectively one ejector element on each chain, the stack may be pushed away from the table and can thus be ejected. Since the stack simultaneously fits against two ejector elements during the ejection operation, a rotating of the stack on the table is to be avoided. The two chains are driven with the aid of a single motor and are moved synchronously during the ejection operation.

U.S. Pat. No. 5,338,149 discloses a stacking device for which only one ejector element is attached to two chains, moving one above the other, wherein this ejector element acts upon the stack. A different stacking device is disclosed in the U.S. Pat. No. 4,103,785, which is also provided with a single ejector element that acts upon the stack and is mounted on two chains, moving one above the other. Additional stacking devices are disclosed in European patent documents EP-A-0 829 441 and the EP-A-1 362 817, which are commonly owned by the Assignee. However, such devices include a stack lift which requires manual interventions in case of a format change. Further, in known stacking devices, the back length of the print products to be stacked, meaning of the respective stack, may be delimited by adjustable flaps that must be opened and closed. This may result in high stress and extend the cycle time.

SUMMARY

A stacking device according to an embodiment of the application may permit a shorter cycle time for the ejection operation, as well as an easier adaptation to different formats for the print products.

According to one embodiment, there is provided a stacking device for print products, comprising: a table to receive the print products, the print products forming a stack; at least two ejector elements arrangeable against the stack to push the stack in an ejection direction away from the table; and at least two drive elements operatively connected, respectively, with the at least two ejector elements so that the at least two ejector elements move independent of one another.

According to one feature of the invention, two ejector elements may be embodied to move independent of each other. As a result, the spacing between these ejector elements may be adjusted continuously for the adaptation to different back lengths of the print products. Since the two ejector elements may be moved independent of each other, the ejector element that is in the lead during the ejection operation may be accelerated and thus may be removed faster than was previously possible from its starting position at the stack. The lead ejector element may be moved to a new starting position, which corresponds to the original starting position of the trailing ejector element during the ejection operation. As a result, a new stack or a new bundle may be formed earlier than previously possible. The ejection is furthermore possible in an optional direction and an unplanned replacement of the ejection device is possible without increasing the cycle time.

According to another embodiment, the table may rotate and the two ejector elements may be arranged such that they may rotate along with the table. As a result, a stack may be formed which includes a plurality of layers of print products respectively arranged to be turned by 180° relative to each other. This may permit a shorter cycle time for the ejection operation, as well as an easier adaptation to different formats for the print products According to another embodiment, a separate motor for driving each drive element may be used, which may allow an independent and secure control of both ejector elements. The two motors may be servo motors, for example, which respectively drive one endless drive element, for example a link chain. As a result, a precise control and quick change in direction may be possible, so that the stack may optionally also be pushed away from the table in the direction counter to the ejection direction.

A particularly short cycle time may be achieved if, according to another embodiment, a first ejector element for pushing away a stack reverses direction and a second ejector element is driven to circulate. Following the pushing away of the stack, the first ejector element may thus return to the starting position by reversing the movement direction, wherein this starting position corresponds to the original starting position of the second ejector element. The second ejector element, which moves away during the ejection of the stack, may be guided around the stack and moved to the already described new starting position which corresponds to the original starting position of the first ejector element. As a result, the path to a new starting position may be shortened considerably for the first ejector element, which is the reason why both ejector elements may be ready faster for a new ejection operation. If the stack is pushed away from the table in a direction counter to the ejection direction, then each of the two ejector elements respectively may assume the function of the other one.

According to a further embodiment, the two ejector elements may function to restrict the back length of the stack. For the format adaptation, the back length of the stack may be changed through a corresponding positioning of the two ejector elements.

According to yet another embodiment, a lift may be arranged inside a recessed area in the table and may be used to press a stack vertically upward and against at least one pressing plate or flap. As a result, the stack may be compacted and the individual print products of a stack may be provided with a pressed fold, which may assist further processing.

Another embodiment provides that the table may be format-variable for adapting it to different format widths of the print products. This may be achieved by providing the table with two outer lift plates which may be adjusted transverse to the ejection direction. Respectively one side wall may be arranged as a limiting element on the two outer lift plates, thus making it possible to adapt to different format widths. The adaptation to different back lengths may be achieved, as previously mentioned, by correspondingly positioning the two ejector elements.

According to another embodiment, the table may be provided with two immovably attached inner lift plates, between which the two ejector elements may traverse, thus ensuring a secure positioning of the stacks and, in particular, also the compressing of the stacks. Owing to the separation into inner lift plates and outer lift plates and the mobility of the outer lift plates, a manual intervention during a format change may not be required.

According to another embodiment, a guide element may be arranged between the inner lift plates for guiding the ejector elements in substantially linear direction, at least in a section where a stack is pushed along, wherein the guide elements may take the form of rollers or a sliding guide. In this way, a compact force transfer without further structural components may be realized.

According to another embodiment, each of the two ejector elements may respectively be attached to an endless drive element such as a link chain. The link chain may be respectively guided around the stack to be ejected, which may be in a semi-circular segment, and may be jointly arranged in an essentially horizontal plane. This may form a semi-circular path segment along which at least one ejector element may be moved. The ejector elements may be respectively attached to a plurality of super-imposed drive elements, wherein each ejector element may be provided with one ejection finger. However, the two ejector elements may in principle also comprise a plurality of ejection fingers.

The stacking device herein described may be used as a cross stacker (or compensating stacker), wherein other applications may also be conceivable.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
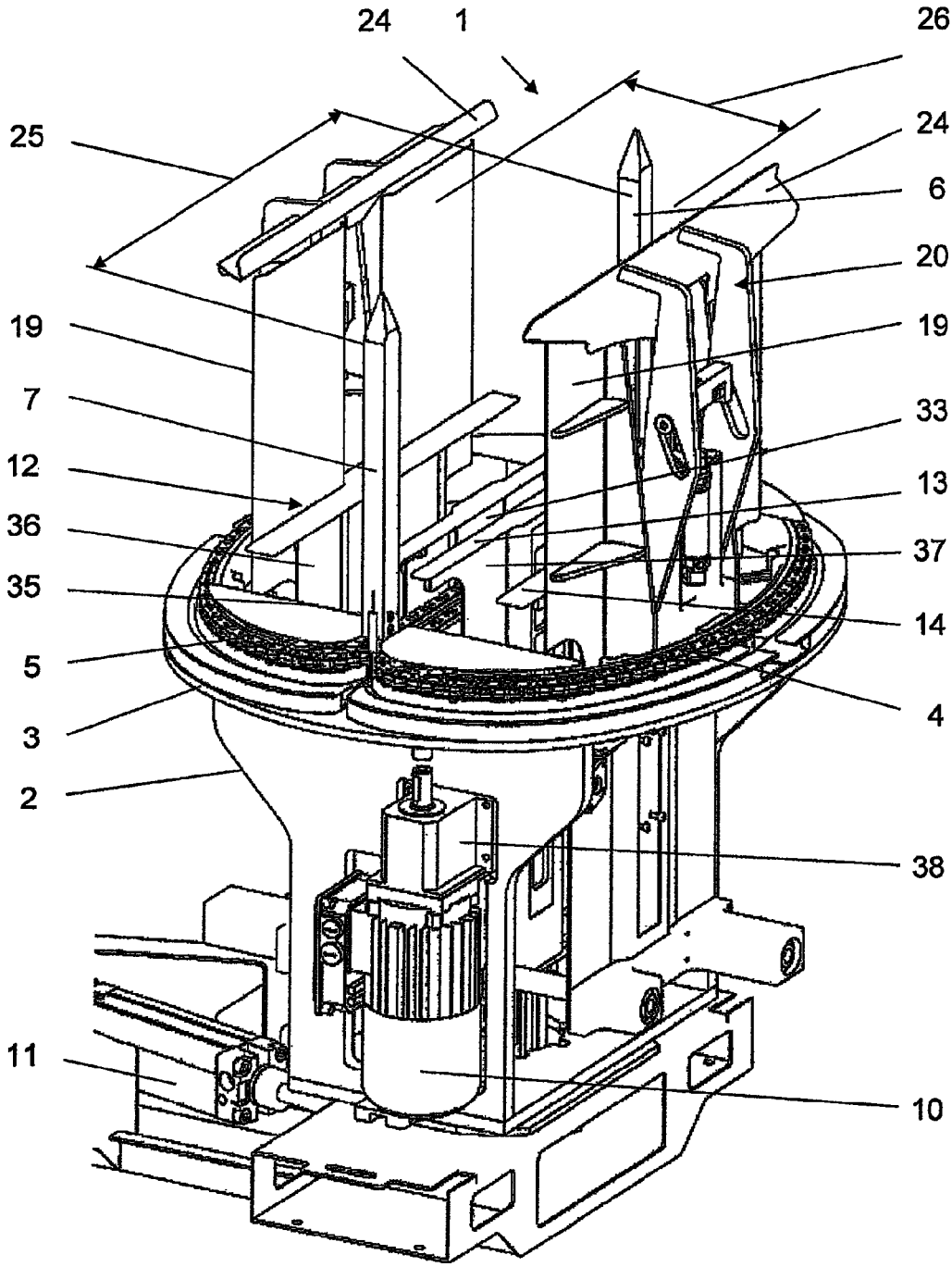
FIGS. 1 and 1A are schematic three-dimensional front and rear perspective views of a stacking device according to an embodiment of the invention.
Figure 2:
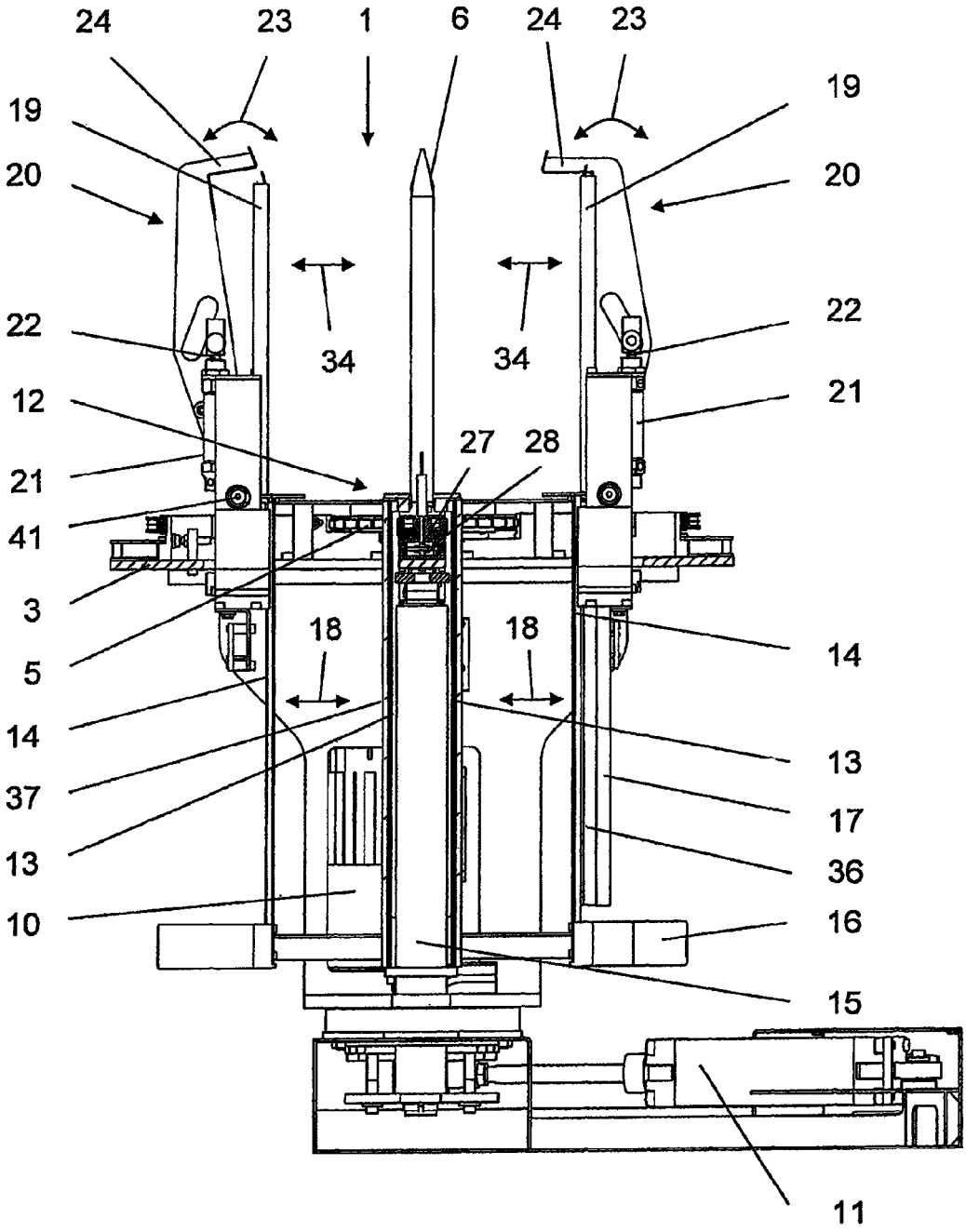
FIG. 2 is a vertical section through the stacking device according to FIG. 1, but seen from the back.

Referring to the embodiment depicted in FIGS. 1 and 2, the stacking device 1 comprises a frame 2 with an essentially horizontal table 3 on which two endlessly circulating drive elements 4, 5 are positioned. A lift 12 that may be provided with two inner lift plates 13 and two outer lift plates 14 is arranged inside a recessed area 35 of the table 3. A stack 8 of print products 9 may be formed on this lift 12, as shown schematically in FIGS. 3*a* to 3*d*. The lift 12 may reduce the drop height for the print products 9. The stack 8 may comprise a plurality of layers of print products 9, which may be respectively rotated relative to each other by 180°. For the stacking operation, the table 3 may be rotated around a vertical axis with the aid of a positioning cylinder 11, wherein this is referred to as the cross stacking and is well known to one skilled in the art.

A stack 8 formed in this way may be compressed or compacted by moving the lift 12 upward against the pressing flaps 20. FIG. 2 shows two pressing flaps 20, arranged on delimiting elements 19, wherein these flaps may be pivoted in or pivoted out and are designed for adjusting to the stack 8 format. To illustrate the function of the pressing flaps, the figure shows on the left side the inactive position where the flaps are pivoted-out around a joint 41 that is arranged on the delimiting element 19. The right side of FIG. 1 depicts the pivoted-in or active position of the flap 20.

For compressing the stack, the respective pressing flaps 20 may be pivoted with the aid of positioning cylinders 21 in the direction of the arrow 23, wherein each positioning cylinder 21 acts upon a pressing flap 20 with the aid of an extendable piston rod 22. For the pivoted-in position, each pressing flap 20 projects with a pressing plate 24 over the respective delimiting element 19 and toward the inside, so that the stack 8 to be compressed may be fitted against the two pressing plates 24 by respectively moving the lift 12 upward. Following the compressing operation, the lift 12 may again be returned to the rest position shown in FIGS. 1 and 2.

The two inner lift plates 13 are arranged at a distance to each other, so that a linear passage 33 exists between them. These inner lift plates 13 are respectively arranged on vertically extending plates 37 which may be coupled to a carrier 15. The outer lift plates 14 may also be provided with downward extending plates 36, which are positioned displaceable on a horizontally extending guide 16 and a vertically extending guide 17. The inner lift plates 13 may be moved in a vertical direction while the outer lift plates may be moved in a vertical as well as horizontal direction. The horizontal movement makes it possible to change the spacing between the two outer lift plates 14, as indicated with the double arrows 18.

By adjusting the outer lift plates 14, the thereto attached delimiting elements 19 may be moved at the same time. The delimiting elements 19 may be plate-shaped and extend past the table 3 in upward direction. In addition, these elements are arranged parallel to each other. The format width 26, indicated in FIG. 1, may be adjusted by repositioning the outer lift plates 14 and the delimiting elements 19. During a change in the production that may require a change in the format width 26, the outer lift plates 14 together with the delimiting elements 19 may be repositioned accordingly, wherein positioning elements (not shown) as well as a control unit (not shown) may be used for making the adjustment.

Figure 1A:
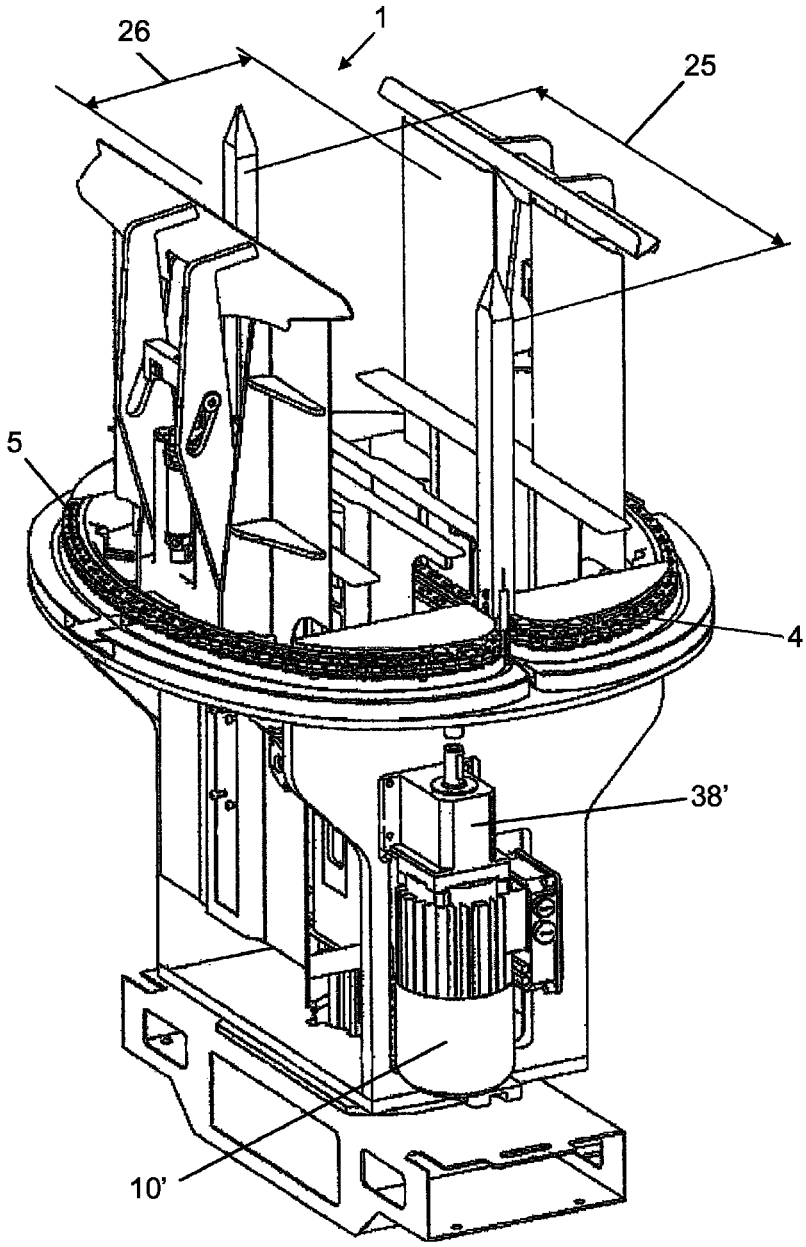
Figure 3A:
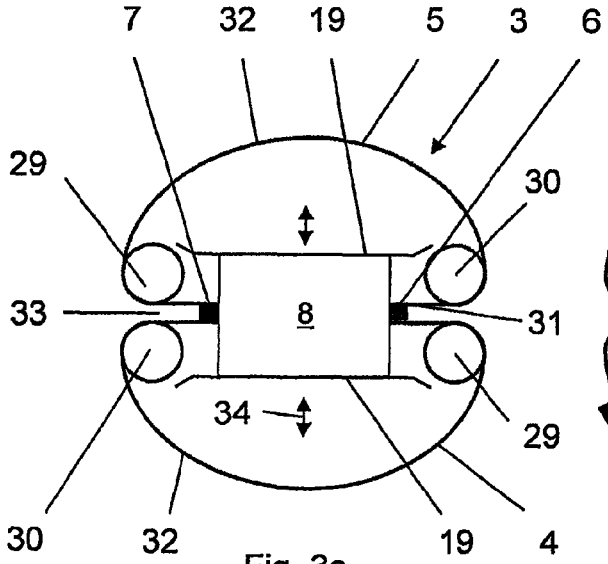
FIGS. 3*a*-3*d* are diagrammatic views of individual stages during the ejection of a stack.

The drive element 4 may be operated with the aid of a motor 10 and via a gear 38. An intervention at the drive element 4 may occur, for example, via a drive wheel 30 that is indicated in FIG. 3*a* and is positioned in the table 3. As shown in FIG. 1A, the drive element 5 may be driven with the aid of an additional motor 10', which may be provided with a gear 38' in the same way as the motor 10. The drive wheel 30 may also be used for the intervention. The two drive elements 4, 5 may be link chains, wherein other types of drive elements may conceivably also be used. Both drive elements 4, 5 may be respectively fitted around a reversing wheel 29 (see FIG. 3*a*) and form essentially a semi-circular segment as seen from the top.

Attached to the drive element 5 is a first ejector element 6 which may be rod-shaped or finger-shaped and may project vertically upward from the table 3. A second ejector element 7 may be attached to the drive element 4 and may be substantially identical to the ejector element 6. The distance between the two ejector elements 6, 7 may determine the back length 25, as indicated in FIG. 1, of a stack 8 to be ejected. Since the two drive elements 4, 5 may be driven independent of each other, the spacing between the two ejector elements 6, 7 may be adjusted continuously. The adjustment may be made via the two aforementioned motors 10, which are connected to a control unit that is not shown herein. The passage 33 between the two inner lift plates 13 may be wide enough, so that the two ejector elements 6, 7 may traverse this passage 33.

FIG. 2 shows that the two ejector elements 6, 7 may be respectively guided linear with the aid of a sliding guide 28 inside a guide element 27. The guide element 27 in FIG. 2 is embodied as guide rail and extends horizontally and in a straight line in the plane for the table 3. However, the guidance may also be achieved using other devices, for example rollers that are not shown herein or the like. Also conceivable is an embodiment for which the ejector elements 6, 7 may be respectively attached to a plurality of drive elements that are arranged one above the other.

Furthermore conceivable is an embodiment where the two ejector elements 6, 7 may be each provided with a plurality of upward projecting rods or fingers or where more than one ejector element is provided on a drive element 4, 5. If the table 3 is rotated around a vertical axis by 180°, as mentioned in the above, the ejector elements 6, 7 may rotate along with the table. With the aid of the two ejector elements 6, 7, a stack 8 that may be formed on the lift 12 and, if applicable, may be compressed, may be supplied to a further processing station. The ejection process is explained in further detail in the following with the aid of FIGS. 3*a* to 3*d*.

FIG. 3*a* schematically shows a view from above of the table 3 with thereon formed stack 8. The stack 8 may be located between two delimiting elements 19 and between the first ejector element 6 and the second ejector element 7. The distances between the two delimiting elements 19 and between the two ejector elements 6, 7 may correspond to the format of the stack 8 or its back length 25 and the format width 26. The double arrows 34 indicate the adjustability of the delimiting elements 19. The first ejector element 6 may be connected to the drive element 5 and the second ejector element 7 may be connected to the drive element 4. These drive elements 4, 5 may be arranged or positioned approximately semi-circular, as may be seen, and may comprise respectively one essentially straight track section 31 and a curved track section 32. The passage 33 may be located between the straight track sections 31. Of course, the curved track sections 32 may also form a different type of track that extends around the stack 8 to be ejected, for example a rectangular or elliptical track.

In the starting position shown in FIG. 3*a*, the two ejector elements 6, 7 may be located within the passage 33 and the stack 8 may be ready to be ejected. The lift is in the lower position shown in FIGS. 1 and 2. In order to eject the stack 8 in FIG. 3*a* to the left, the second ejector element 7 that delimits the back length 25 of the stack 8 is initially removed from the stack 8 with the aid of the drive element 4. The ejector element then travels out of the passage 33, as may be seen in FIG. 3*b*, and is guided on the side into the curved track section 32 of the drive element 4. Essentially at the same time, the first ejector element 6 starts the process of ejecting the stack 8 in an ejection direction 39, meaning to the left, and is thus moved to the left in FIG. 3*b*. The second ejector element 7 is located on the curved track section 32, for example in the position as shown in FIG. 3*c*. The stack 8 has meanwhile been ejected almost completely by the first ejector element 6, as shown in FIG. 3*c*.

During this ejection movement, the stack 8 is guided between the two delimiting elements 19. The first ejector element 6 then moves even further to the left, starting with the representation shown in FIG. 3*c*, and completely pushes the stack 8 in ejection direction 39 from the table 3, so that the stack 8 may be taken over by a conveying device not shown herein. The second ejection device 7 is then moved to the position shown in FIG. 3*d*, which corresponds to the one occupied by the first ejector element 6 in FIG. 3*a*.

Figure 3B:
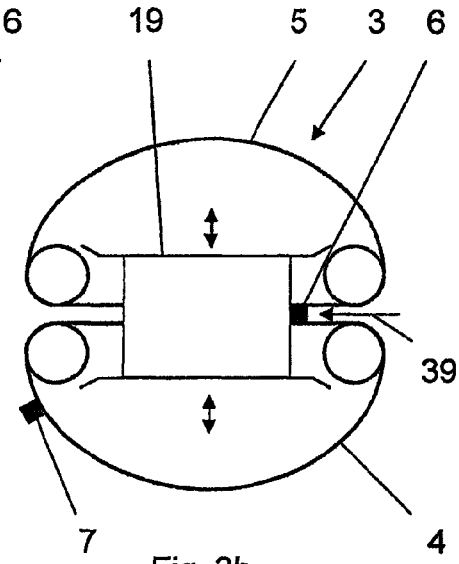
Figure 3C:
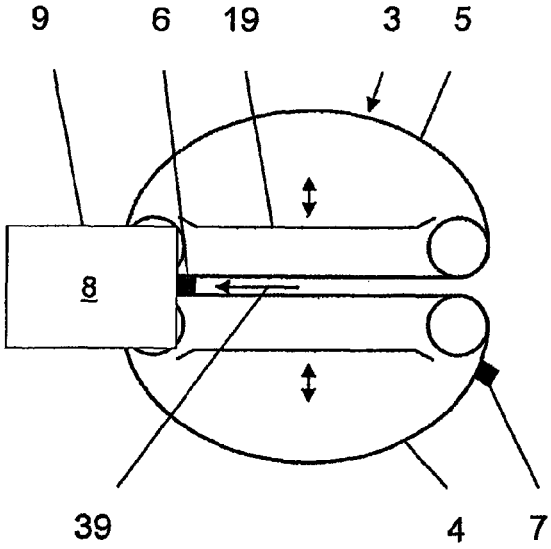
Figure 3D:
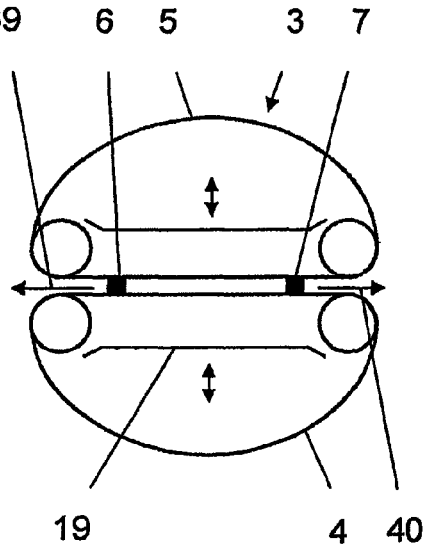

The first ejector element 6 is moved to the position shown in FIG. 3*d* through a reversal of its movement caused by the drive element 5. This position corresponds to the position of the second ejector element 7 as shown in FIG. 3*a*. To move the first ejector element 6 into the position shown in FIG. 3*d*, the drive element 5 is driven in reverse direction. During the ejection operation, the drive element 4 always moves in the same direction. The drive element 5, on the other hand, is first moved in clockwise direction and then in counter-clockwise direction, following the ejection of the stack 8.

FIGS. 3*a* to 3*c* show that the stack 8 is ejected from the right to the left. However, it is also possible to eject the stack from the left to the right. In that case, each of the ejector elements 6, 7 assumes the function of the respectively other ejector element. FIG. 3*d* shows the possible ejection directions 39, 40. As may be seen, the two drive elements 4, 5 may be controlled to move independent of each other. Each of the two ejector elements 6, 7 can thus be moved with different speed and the movement direction can also be changed at any time.

The spacing between the two ejector elements 6, 7 can furthermore be adjusted with the aid of corresponding movements of the drive elements 4, 5. A shorter cycle time during the ejection operation and the option of adapting to different back lengths through a corresponding repositioning of the two ejector elements 6, 7 may be achieved with the embodiments described above. The above-mentioned compressing of the stack 8 through raising the lift 12 and the cross stacking of a stack as a result of the rotational movements of the table 3 are known per se. However, embodiments are also conceivable where the table 3 does not rotate or where a compressing of the stack 8 is not planned.

It will be understood that the above description of the present invention is susceptible to various modifications, changes and adaptations, and the same are intended to be comprehended within the meaning and range of equivalents of the appended claims.

What is claimed is:

1. A stacking device for print products, comprising:

a table to receive the print products, the print products forming a stack, wherein the table defines a recessed area, wherein a pressing flap and a lift are arranged inside the recessed area, and wherein the lift is operable to compress the stack by moving the stack in a vertical upward direction to press the stack against the pressing flap;

at least two ejector elements arrangeable against the stack to push the stack in an ejection direction away from the table; and at least two drive elements each coupled to a respective one of the at least two ejector elements so that the at least two ejector elements are configured to move independent of one another, wherein at least one of the at least two ejector elements is moved along a substantially semi-circular path, wherein the lift comprises two inner lift plates separated from each other and the at least two ejector elements are arranged to traverse between the two inner lift plates, and wherein the lift comprises two outer lift plates which are adjustable transverse to the ejection direction.

2. The stacking device according to claim 1, wherein the at least two ejector elements are arranged on the table and the table with the at least two ejector elements is rotatable.

3. The stacking device according to claim 1, further comprising at least two motors, wherein the at least two drive elements are driven by a respective one of the drive motors.

4. The stacking device according to claim 1, wherein at least one of the ejector elements is operative to push the stack in a direction counter to the ejection direction.

5. The stacking device according to claim 1, wherein as the stack is pushed away from the table in the ejection direction, one of the ejector elements reverses from the ejection direction and the other one of the ejector elements circulates.

6. The stacking device according to claim 1, wherein the at least two ejector elements are repositionable for adapting to a back length of the stack to be ejected.

7. The stacking device according to claim 1, further comprising a substantially semi-circular track arranged around the stack, wherein the at least one of the at least two ejector elements is moved along the track in the substantially semi-circular path.

8. The stacking device according to claim 1, wherein the at least two drive elements each comprises an endlessly circulating element and each of the at least two ejector elements is coupled to a respective one of the at least two drive elements.

9. The stacking device according to claim 1, further comprising two opposite-arranged delimiting elements arranged at a distance relative to each other, wherein the delimiting elements project upward from the table and are adjustable to change the distance for adapting to a format width of the printed products that form the stack.

10. The stacking device according to claim 9, further including at least one pressing flap arranged to pivot relative to one of the delimiting elements, the at least one pressing flap having a pivotable in-state and a pivotable out-state, wherein the pressing flap projects inwardly over the delimiting element in the pivotable in-state.

11. The stacking device according to claim 10, wherein the delimiting elements with the pressing flaps are adjustable transverse to the ejection direction.

12. The stacking device according to claim 1, further comprising a guide element arranged between the two inner lift plates, wherein the ejector elements are guided along the guide element linearly in at least one section where the stack is pushed.

13. A method of cross stacking stacks of printed products, comprising utilizing the stacking device according to claim 1.

14. A stacking device for print products according to claim 1, whereby one of the at least two ejector elements is driven by one of the at least two drive elements from a first starting position to push the stack away from the table in the ejection direction and the other of the at least two ejector elements is driven by the other of the at least two drive elements from a second starting position and circulates to the first starting position, and whereby, after the stack is ejected from the table, the one of the at least two ejector elements is driven by the one of the at least two drive members opposite the ejection direction to the second starting position.

15. The stacking device according to claim 14, further comprising at least two substantially semi-circular tracks arranged around the stack, wherein the at least two ejector elements are moved in a substantially semi-circular path along a respective one of the tracks.

* * * * *